US010428553B2

(12) United States Patent
Parenti

(10) Patent No.: US 10,428,553 B2
(45) Date of Patent: Oct. 1, 2019

(54) FENCE POST WITH METAL INSERT

(71) Applicant: Steven Joseph Parenti, Lodi, CA (US)

(72) Inventor: Steven Joseph Parenti, Lodi, CA (US)

( * ) Notice: Subject to any disclaimer, the term of this patent is extended or adjusted under 35 U.S.C. 154(b) by 183 days.

(21) Appl. No.: 15/710,929

(22) Filed: Sep. 21, 2017

(65) Prior Publication Data

US 2019/0085592 A1 Mar. 21, 2019

(51) Int. Cl.
*E04H 17/22* (2006.01)
*E04H 12/22* (2006.01)

(52) U.S. Cl.
CPC ..... *E04H 17/22* (2013.01); *E04H 12/2215* (2013.01)

(58) Field of Classification Search
CPC ..... E04H 17/20; E04H 17/22; E04H 12/2215; E04H 12/2253; E04H 12/2261; E04F 11/1812
See application file for complete search history.

(56) References Cited

U.S. PATENT DOCUMENTS 2,158,291 A * 5/1939 Lank ..... F16B 12/14 191/64
3,200,554 A * 8/1965 Goodman ..... A47B 91/00 362/431
4,175,883 A * 11/1979 Lemelson ..... A01G 17/14 256/65.11
5,735,310 A 4/1998 Hipshire ..... 256/66
5,862,642 A 1/1999 Erwin ..... 52/736.3
6,173,945 B1 1/2001 Lindsey et al. ..... 256/24
6,530,561 B2 3/2003 Larsen et al. ..... 256/24
6,840,507 B2 1/2005 Brown ..... 256/65.01
7,571,897 B2 8/2009 Heinz ..... 256/65.03
7,971,412 B1 * 7/2011 Lim ..... E04F 11/1814 52/298
8,117,798 B2 * 2/2012 Bergman ..... E04H 12/2253 256/65.14
8,505,880 B2 8/2013 Langenwalter ..... 256/65.12
9,976,298 B2 * 5/2018 Bergman ..... E04B 1/486
(Continued)

OTHER PUBLICATIONS

Home-Dzine article, entitled "Easy garden fence" (downloaded from http://www.home-dzine.co.za/diy/diy-easy-fence.htm on Aug. 8, 2017), 3 pages.

*Primary Examiner* — Daniel J Wiley
(74) *Attorney, Agent, or Firm* — Alfred A. Equitz

(57) ABSTRACT

A fence post assembly including a wood post member (having a longitudinal axis, a first end surface, and a second end surface) and an elongated metal insert (having an insert longitudinal axis, a first end surface, and a second end surface), where the metal insert is positioned within the wood post member, with the first end surface of the metal insert at least substantially aligned with the first end surface of the wood post member, and the insert longitudinal axis at least substantially aligned with the longitudinal axis of the wood post member. Typically, the metal insert is longitudinally shorter than the wood post member so that the metal insert does not extend into an end portion of the fence post assembly, allowing the end portion to be conveniently trimmed off or otherwise processed, e.g., during or after installation. Other aspects are methods for manufacturing or installing any embodiment of the fence post assembly.

17 Claims, 2 Drawing Sheets

(56) References Cited

U.S. PATENT DOCUMENTS

| | | | | |
|---|---|---|---|---|
| 2005/0252124 | A1* | 11/2005 | Bergman | E04H 12/2253 52/296 |
| 2012/0131879 | A1* | 5/2012 | Bergman | E04F 11/1812 52/704 |
| 2017/0175384 | A1* | 6/2017 | Bergman | E04B 1/486 |

* cited by examiner

FENCE POST WITH METAL INSERT

TECHNICAL FIELD

The invention pertains to a fence post assembly which includes a metal insert in a wood post member, a method for manufacturing the post assembly, and a method for installing the post assembly.

BACKGROUND

Throughout this disclosure including in the claims, the term "wood" is used as a noun to denote the hard, fibrous substance which composes most of the stem and branches of a tree or shrub, and as an adjective to denote "made of wood" or "wooden."

Throughout this disclosure including in the claims, the expression that an object (e.g., a metal insert) is an "elongated" object denotes that the object has a longitudinal axis and has substantially greater (typically, much greater) size (length) along the longitudinal axis than along any direction perpendicular to the longitudinal axis.

Fence posts made of wood, plastic, or metal are conventionally used as elements of fences. It is also known to use a fence post assembly, including a plurality of elements assembled together (typically by a user as a step of fence installation), in place of a fence post (e.g., a fence post made of wood).

A typical wood fence post has a number of desirable attributes, including that it is easy to install (e.g., using simple, conventional fence installation methods) and inexpensive. However, a wood fence post (when it has been installed as an element of a typical fence) is typically subject to rotting or other deterioration, mainly due to chemical reaction of the fence post wood with dirt and water to which it is exposed (and other environmental factors). The deterioration typically causes the post to lose strength (and/or to warp) over time after installation, until the amount of strength loss and/or warping become unacceptable in the sense that the post needs to be replaced or reinforced.

Typical installation of a conventional wood fence post includes a step of anchoring the post in concrete, followed by attachment of other fence structure (e.g., fence rails) to the anchored post. The portion of the installed post above the concrete anchor is subject to the earliest and most rapid rotting and/or other deterioration, due to interaction of exposed wood with soil and water and other environmental factors.

One conventional method for reinforcing an installed, deteriorated conventional wooden post is to pound a reinforcing part (e.g., a metal part) into the earth (or into concrete or the like which anchors the post) and against the post until the part is positioned to support the deteriorated post.

The inventor of the present invention has recognized that there is a need for a substitute for a conventional wood fence post, where the substitute is designed and structured so as not to be subject to unacceptable loss of strength (and/or unacceptable warping) due to rotting or other deterioration after installation (or to have a substantially longer expected useful life after installation than does a conventional wood post, before becoming subject to unacceptable strength loss and/or warping due to deterioration). The inventor has also recognized that such a substitute is desirably a pre-assembled, simple structure (not requiring assembly by the user before or during installation) which is ready for easy installation by the user (e.g., installation in the same manner as conventionally employed to install a conventional wood fence post), and is preferably inexpensive to manufacture (relative to more complex fence post structures and fence post structures including more expensive materials).

Some conventional fence post equipment undesirably requires user assembly before or during installation. For example, one such conventional product includes a metal frame and wooden cladding which must be bolted or otherwise fastened to the frame by the user during installation.

BRIEF DESCRIPTION OF THE INVENTION

In a class of embodiments, the invention is a fence post assembly including a wood post member (having a longitudinal axis, a first end surface, and a second end surface) and an elongated metal insert (having an insert longitudinal axis, a first end surface, and a second end surface), wherein the metal insert is positioned within the wood post member, with the first end surface of the metal insert at least substantially aligned with the first end surface of the wood post member, and the insert longitudinal axis at least substantially aligned with the longitudinal axis of the wood post member. Typically, the metal insert is a metal pipe having an annular cross-section (in planes perpendicular to the insert longitudinal axis). Typically, the metal insert is longitudinally shorter than the wood post member (the distance between the first end surface and second end surface of the metal insert is less than the distance between the first end surface and second end surface of the wood post member), so that the metal insert does not extend into an end portion of the fence post assembly (i.e., an end portion including the second end surface of the wood post member). This allows the end portion of the fence post assembly to be conveniently trimmed off (or otherwise processed), e.g., during or after installation of the fence post assembly.

In a class of embodiments, the invention is a method for manufacturing a fence post assembly, including steps of: removing wood from a first end of a solid wood piece having a longitudinal axis, a first end surface, and a second end surface (e.g., by drilling into the first end surface of the wood piece), thereby producing a wood post member having a cavity defined therein, said wood post member having the longitudinal axis, a cored first end surface, and the second end surface (preferably, this is the only step of removing wood from the solid wood piece or wood post member, so that preferably no additional cavity is formed therein); and ramming an elongated metal insert, having an insert longitudinal axis, a first end surface, and a second end surface, into the cavity defined in the wood post member, such that the insert is held by friction within the wood post member with the first end surface of the metal insert at least substantially aligned with the cored first end surface of the wood post member, and the insert longitudinal axis at least substantially aligned with the longitudinal axis of the wood post member.

Benefits of typical embodiments of the inventive fence post assembly include all or some of the following:

the fence post assembly is structured so as not to be subject to unacceptable loss of strength (and/or unacceptable warping) due to deterioration (e.g., rotting) after installation, and/or to have a substantially longer expected useful life than does an installed conventional (i.e., solid) wood fence post before becoming subject to unacceptable strength loss and/or unacceptable warping due to deterioration. Thus, the inventive fence post assembly typically do not need to be replaced or repaired after installation, and/or have a substantially longer useful life than a typical installed conventional wood fence post;

the fence post assembly is a pre-assembled structure (not requiring assembly by the user during or before installation) which is ready for easy installation by the user. Thus, a typical embodiment of the inventive fence post assembly is pre-assembled and ready for installation in the same manner as conventionally employed to install a conventional (purely wooden) wood post;

the fence post assembly has a simple structure and is inexpensive (relative to more complex fence post structures and/or fence post structures including more expensive materials); and the fence post assembly is easily installable and usable, e.g., using conventional methods for installing a conventional (purely wooden) fence post, and conventional methods for constructing a fence which includes a conventionally installed wooden fence post, without the need for extra parts (e.g., brackets) as are required for installation of some conventional fence post assemblies which include metal and/or plastic components.

Other aspects of the invention are methods for manufacturing any embodiment of the inventive fence post assembly, and methods for installing any embodiment of the inventive fence post assembly.

DETAILED DESCRIPTION OF PREFERRED EMBODIMENTS

Embodiments of the inventive fence post assembly will be described with reference to FIGS. 1-5.

In a class of embodiments, the inventive fence post assembly includes a wood post member (having a longitudinal axis, a first end surface, and a second end surface) and an elongated metal insert (having a longitudinal axis, to be referred to herein as an insert longitudinal axis, a first end surface, and a second end surface), wherein the metal insert is positioned within the wood post member, with the first end surface of the metal insert at least substantially aligned with the first end surface of the wood post member, and the insert longitudinal axis at least substantially aligned with the longitudinal axis of the wood post member. The metal insert is positioned "within" the wood post member in the sense that at least a major portion of the metal insert (sufficient to provide structural support to the wood post member) is within the wood post member. Typically, the metal insert is positioned entirely within the wood post member, either with the entire metal insert recessed (e.g., by less than an inch or a half inch) within the wood post member, or so that the first end surface of the metal insert is exactly (or as precisely as practical) aligned with the first end surface of the wood post member. However, in some embodiments of the assembly in which the first end surface of the metal insert is substantially, but not exactly, aligned with the first end surface of the wood post member, an end portion (e.g., an end portion of length less than an inch or a half inch) of the metal insert may protrude out from the first end surface of the wood post member.

Preferably, the fence post assembly is manufactured so that the first end surface of the metal insert of the assembly is aligned with the first end surface of the wood post member as precisely as is practical. For example, a ram (e.g., a hydraulic ram) may be used to pound the metal insert into a cavity in the wood post member (e.g., the cavity having been predefined by drilling into a post to define the cavity so that said cavity is sized and shaped for receiving the metal insert), with the ram having a distal end (which contacts the metal insert) which is sized, shaped, and positioned to contact a portion of the first end surface of the wood post member when the metal insert has advanced just far enough into the cavity so that the first end surface of the metal insert of the assembly is aligned with the first end surface of the wood post member. In the example, after the ramming step, the first end surface of the metal insert of the assembly is aligned with the first end surface of the wood post member to within tolerances of the ram and its method of operation.

Figure 3:
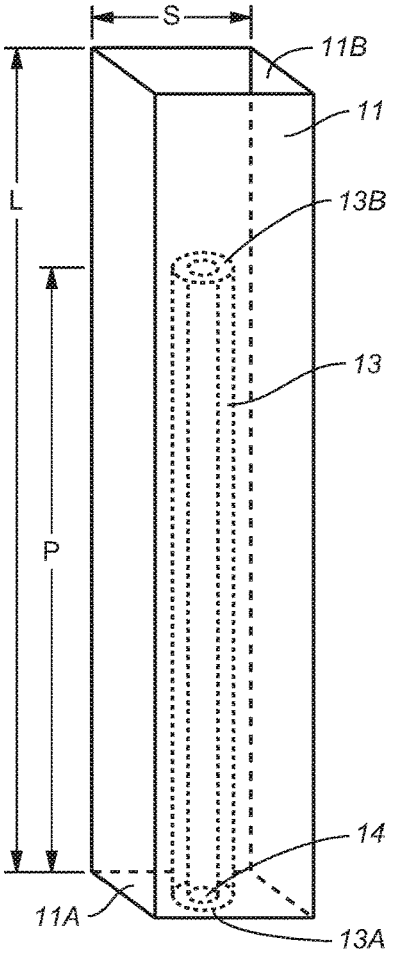
FIG. 3 is perspective view of an embodiment of the inventive fence post assembly, which includes an annular metal insert (shown in phantom view) in a wood post member having a square outer periphery.
Figure 4:
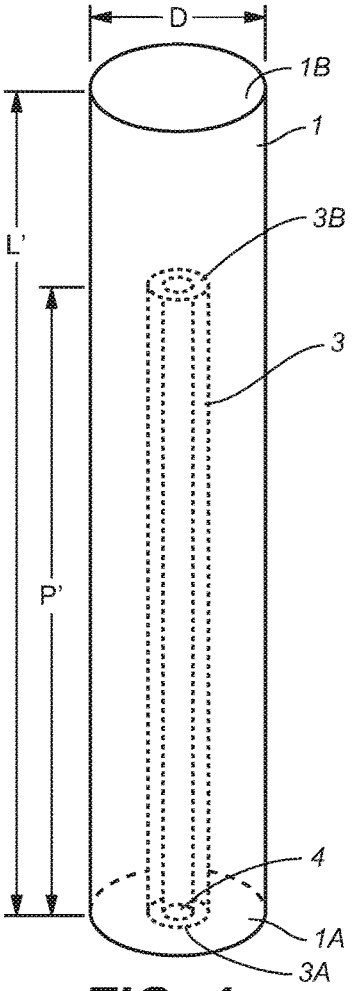
FIG. 4 is perspective view of an embodiment of the inventive fence post assembly, which includes an annular metal insert (shown in phantom view) in a wood post member having a circular outer periphery.

For example, the embodiment of the inventive fence post assembly shown in FIG. 3 includes elongated wood post member 11 (having first end surface 11A, second end surface 11B, a longitudinal axis perpendicular to surfaces 11A and 11B, and length L along the longitudinal axis), and the embodiment of the inventive fence post assembly shown in FIG. 4 includes elongated wood post member 1 (having first end surface 1A, second end surface 1B, a longitudinal axis perpendicular to surfaces 1A and 1B, and length L' along the longitudinal axis).

The FIG. 3 embodiment also includes elongated metal insert 13 (shown in phantom view) positioned within member 11. Insert 13 has an annular first end surface 13A, an annular second end surface 13B, a longitudinal axis perpendicular to surfaces 13A and 13B, and length P along the longitudinal axis.

The FIG. 4 embodiment also includes elongated metal insert 3 (shown in phantom view) positioned within member 3. Insert 3 has an annular first end surface 3A, an annular second end surface 3B, a longitudinal axis perpendicular to surfaces 3A and 3B, and length P' along the longitudinal axis.

Metal insert 13 of FIG. 3 is positioned within wood post member 11 (in longitudinally elongated cavity 14 which has been drilled into member 11), with end surface 13A aligned with end surface 11A of member 11. In variations on the FIG. 3 embodiment, metal insert 13 is positioned within post member 11 (in cavity 14) with end surface 13A substantially aligned (but not exactly aligned) with end surface 11A of member 11, either:

so that surface 13A protrudes (longitudinally out from member 11) slightly beyond surface 11A; or so that insert 13 is entirely within cavity 14, with a bottom end portion of member 11 extending longitudinally slightly beyond surface 13A.

Similarly, metal insert 3 of FIG. 4 is positioned within wood post member 1 (in longitudinally elongated cavity 4 which has been drilled into member 1), with end surface 3A aligned with end surface 1A of member 1. In variations on the FIG. 4 embodiment, metal insert 3 is positioned within post member 1 (in cavity 4) with end surface 3A substantially aligned (but not exactly aligned) with end surface 1A of member 1, either:

so that surface 3A protrudes (longitudinally out from member 1) slightly beyond surface 1A; or so that insert 3 is entirely within cavity 4, with a bottom end portion of member 1 extending longitudinally slightly beyond surface 3A.

Figure 2:
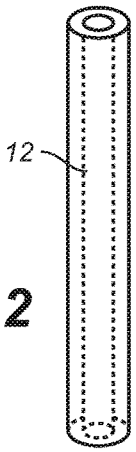
FIG. 2 is a perspective view of an elongated metal pipe which may be used to manufacture an embodiment of the inventive fence post assembly.

Typically, the metal insert of the inventive fence post assembly is a metal pipe having an annular cross-section (in planes perpendicular to the insert's longitudinal axis), as is each of pipe 12 of FIG. 2, insert 13 of FIG. 3, and insert 3 of FIG. 4. Alternatively, the metal insert has another shape (e.g., it is a solid, elongated, cylindrical rod, or another solid elongated item, or an elongated item shaped so that its cross-section in planes perpendicular to its insert longitudinal axis is non-annular).

Typically, the metal insert of the inventive fence post assembly is longitudinally shorter than the wood post member of the assembly (e.g., as insert 13 of FIG. 3 is longitudinally shorter than member 11, and insert 3 of FIG. 4 is longitudinally shorter than member 1), so that the metal insert does not extend into an end portion of the fence post assembly. For example, metal insert 13 of FIG. 3 does not extend into the upper end portion of member 11 including second end surface 11B (i.e., the distance P between first and second end surfaces 13A and 13B of insert 13 is less than the distance L between first and second end surfaces 11A and 11B of member 11), and metal insert 3 does not extend into the upper end portion of member 1 including second end surface 1B. This feature desirably allows the end portion of the fence post assembly (into which the metal insert does not extend) to be oriented as the upper end of the assembly during installation (e.g., as is the installed fence post assembly shown in FIG. 5), and to be conveniently trimmed off (or otherwise processed), e.g., during or after installation of the fence post assembly, without the need to cut through the metal insert.

In typical embodiments, the overall length (along the longitudinal axis) of the wood post member of the inventive fence post assembly, and thus the overall length (along the longitudinal axis of the wood post member) of the post assembly, is equal to L, where L is greater than (or at least substantially equal to) 5 feet, and the length (along the insert longitudinal axis) of the metal insert of the assembly is equal to P, where P is in the range $(0.60)\ L \leq P \leq (0.99)\ L$. Preferably, L is at least substantially equal to 8 feet, and $(0.60)\ L \leq P \leq (0.75)\ L$. For example, in one such embodiment, L=8 feet, and P=5 feet=(0.625) L. For another example, in another such embodiment, L=8 feet, and P=5.5 feet=(0.687) L.

In preferred embodiments, the wood post member of the inventive fence post assembly has a square or round perimeter (in a plane perpendicular to its longitudinal axis). For example, member 11 of FIG. 3 has such a square perimeter (with the perimeter's sides having length S), and member 1 of FIG. 4 has such a round (circular) perimeter (with the circular perimeter having diameter D).

It is expected that, in typical embodiments, the wood post member of the inventive structure is about 8 feet long (e.g., L is about 8 feet in FIG. 3, and L' is about 8 feet in FIG. 4), with cross-section (in a plane perpendicular to its longitudinal axis) having an outer periphery which is a 3.5 inch square (e.g., S=3.5 inches in FIG. 3) or a 4 or 6 inch circle (e.g., D=4 inches, or D=6 inches, in FIG. 4). A typical method for manufacturing such a structure is as follows: a solid wood post is longitudinally drilled partially (e.g., 5 or 5.5 feet into its bottom end, when the overall length of the wood post is 8 feet or substantially equal to 8 feet) to produce a wood post member having a cavity cored into one end (the end intended to be the bottom end of the structure when it has been installed); and a metal member (pipe) having annular cross-section (e.g., 10 or 12 gauge pipe having outer diameter of about 1.25 inches, where 10 gauge pipe has 0.126-0.136 inch wall thickness, and 12 gauge pipe has 0.101-0.111 inch wall thickness) is pounded (rammed) into the cavity in the wood post member so as to be held therein by friction. Positioning the metal insert in only the lower portion (e.g., the lower 5 to 5.5 feet of an 8 foot post assembly) allows the top portion of the post assembly desirably to be exactly the same as the top portion of a conventional wooden post (so users can employ conventional fence assembly methods, which typically include trimming off the uppermost segment of the installed post above the top of a fence railing which has been attached to the installed post), while preventing loss of strength due to deterioration of the post (which mainly occurs at or near to ground level, due to chemical reaction of the wooden portion of the post assembly with dirt/water) after installation. The wood portion of the inventive assembly (or the wood portion of the inventive assembly above a concrete anchor, when the assembly has been anchored in concrete) is the portion most likely to have the fastest rate of deterioration (due to interaction with soil, water, and environmental factors). The metal insert of the inventive assembly maintains the assembly's strength despite rotting or other deterioration of the assembly's wood portion.

In some alternative embodiments, the metal insert of the inventive fence post assembly extends all (or almost all) the way longitudinally within the wood post member of the assembly.

Figure 1:
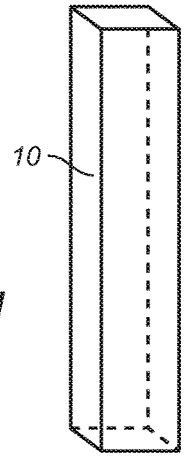
FIG. 1 is a perspective view of a wood post which may be used to manufacture an embodiment of the inventive fence post assembly.

In a class of embodiments, the invention is a method for manufacturing a fence post assembly, including steps of:

(a) removing wood from a first end of a wood piece (preferably an elongated, solid wood piece, e.g., solid wood post 10 of FIG. 1) suitable for use as a wood fence post, and having a longitudinal axis, a first end surface, and a second end surface (e.g., the wood removal is performed by drilling into the first end surface of the wood piece), thereby producing a wood post member having a cavity defined therein, said wood post member having the longitudinal axis, a cored first end surface, and the second end surface. Preferably, this is the only step of removing wood from the solid wood piece or wood post member, so that preferably no additional cavity is formed therein; and (b) ramming an elongated metal insert (e.g., annular metal pipe 12 of FIG. 1), having an insert longitudinal axis, a first end surface, and a second end surface, into the cavity defined in the wood post member, such that the insert is positioned (and preferably, held by friction) within the wood post member with the first end surface of the metal insert at least substantially aligned with the cored first end surface of the wood post member, and the insert longitudinal axis at least substantially aligned with the longitudinal axis of the wood post member.

Typically, the method insert is an annular metal pipe. Also typically, the cavity is at least substantially cylindrical, and step (a) includes longitudinally drilling out an at least substantially cylindrical inner portion of the wood piece, thereby defining said cavity in the wood piece.

A method in the noted class of embodiments can be performed to produce the post assembly of FIG. 3 (also shown, installed in the earth, in FIG. 5), with wood post member 11 of FIG. 3 being produced by removing wood from post 10 of FIG. 1 (defining the cavity 14 in member 11), and ramming metal insert 13 (which can be identical to pipe 12 of FIG. 2, with it being understood that FIGS. 1-3 and 5 are not drawn to the same scale) into cavity 14 of member 11. Cavity 14 is typically defined by longitudinally drilling out a cylindrical volume from a wood piece (e.g., wood post 10 of FIG. 1), thereby producing wood member 11 having cavity 14, with the cavity 14 being sized and shaped to receive an annular metal insert (e.g., insert 13) such that (after the ramming step) the insert is retained in wood member 11 by friction between the outer cylindrical surface of the insert and the cylindrical side surface of cavity 14.

Preferably, the elongated metal insert has a length (along the insert longitudinal axis) P, the wood post member has a length (along the longitudinal axis) L, and P≤L. More preferably, P is substantially less than L. In typical embodiments, the overall length (along the longitudinal axis) of the wood piece (and of the wood post member) and thus the overall length (along the longitudinal axis of the wood post member) of the fence post assembly is equal to L, and L is greater than (or at least substantially equal to) 5 feet, and the length, P, of the metal insert is in the range (0.60) L≤P≤(0.99) L. Preferably, L is at least substantially equal to 8 feet, and (0.60) L≤P≤(0.75) L. For example, in one such embodiment, L=8 feet, and P=5 feet=(0.625) L. For another example, in another such embodiment, L=8 feet, and P=5.5 feet=(0.687) L.

In a second class of embodiments, the invention is a method for manufacturing a fence post assembly, including steps of:

(a) providing an elongated metal insert (e.g., a metal pipe), having an annular cross-section, an insert longitudinal axis, a first end surface, a second end surface, and a length (along the insert longitudinal axis) P, and a wood post. Preferably, the wood post has a cross-section having a periphery which is a square or a circle, and the elongated metal insert has an annular cross-section;

(b) removing (e.g., longitudinally drilling out, with a hydraulic drill) an at least substantially cylindrical inner portion of the wood post, thereby defining a cavity in the wood post and producing a cored wood post member having the cavity, where the cored wood post member has a longitudinal axis, a first end surface, and a second end surface, a length (along the longitudinal axis) L, and said cavity is of size and shape to receive at least a major portion of the metal insert (where said at least a major portion of the metal insert may be all or substantially all of the metal insert). Preferably, the cavity has a length which is at least substantially equal to P. Also preferably, step (b) is the only step of removing wood from the solid wood post or cored wood post member, so that preferably no additional cavity is formed therein;

(c) inserting (e.g., by ramming, using a hydraulic ram) the metal insert into the cavity of the cored wood post member, such that the metal insert is positioned relative to the cored wood post member with at least a major portion of the metal insert (e.g., the entire metal insert) within the cored wood post member, and with the first end surface of the metal insert at least substantially aligned with the first end surface of the cored wood post member, and the insert longitudinal axis at least substantially aligned with the longitudinal axis of the cored wood post member, thereby producing the fence post assembly.

In typical embodiments, P≤L, and preferably, P is substantially less than L. In typical embodiments, the overall length (along the longitudinal axis) of the wood post (and of the cored wood post member) and thus the overall length (along the longitudinal axis of the wood post member) of the post assembly is equal to L, and L is greater than (or at least substantially equal to) 5 feet, and the length, P, of the metal insert is in the range (0.60) L≤P≤(0.99) L. Preferably, L is at least substantially equal to 8 feet, and (0.60) L≤P≤(0.75) L. For example, in one such embodiment, L=8 feet, and P=5 feet=(0.625) L. For another example, in another such embodiment, L=8 feet, and P=5.5 feet=(0.687) L.

A method in the second class of embodiments can be performed to produce the post assembly of FIG. 3 (also shown, installed in the earth, in FIG. 5), with cored wood post member 11 of FIG. 3 being produced by removing wood from post 10 of FIG. 1 (defining the cylindrical cavity 14 in member 11), and inserting annular metal insert 13 (which can be identical to pipe 12 of FIG. 2, with it being understood that FIGS. 1-3 and 5 are not drawn to the same scale) into cavity 14 of member 11. Cavity 14 is typically defined by longitudinally drilling out a cylindrical volume from a wood piece (e.g., wood post 10 of FIG. 1), thereby producing wood member 11 having cylindrical cavity 14 having length at least substantially equal to P (the length of the insert), with the cavity 14 being sized and shaped to receive annular metal insert 13 such that (after the insertion step) the insert is retained in member 11 by friction between the outer cylindrical surface of the insert and the cylindrical side surface of cavity 14. Preferably, step (b) is performed at a first station (a first location in a manufacturing facility); step (c) is performed at a second station (a second location in the manufacturing facility); and the method includes a step of: after step (b) and before step (c), conveying the cored wood post member to the second station. Step (c) is typically an automated ramming (pounding) step, e.g., performed using a hydraulic ram.

Benefits of typical embodiments of the inventive fence post assembly include all or some of the following:

the fence post assembly is structured so as not to be subject to unacceptable loss of strength (and/or unacceptable warping) due to deterioration (e.g., rotting) after installation, and/or to have a substantially longer expected useful life than does an installed conventional (i.e., solid) wood fence post before becoming subject to unacceptable strength loss and/or unacceptable warping due to deterioration. Thus, the inventive fence post assembly typically do not need to be replaced or repaired after installation, and/or have a substantially longer useful life than a typical installed conventional wood fence post;

the fence post assembly is a pre-assembled structure (not requiring assembly by the user during or before installation) which is ready for easy installation by the user. Thus, a typical embodiment of the inventive fence post assembly is pre-assembled and ready for installation in the same manner as conventionally employed to install a conventional (purely wooden) wood post;

the fence post assembly has a simple structure and is inexpensive (relative to more complex fence post structures and/or fence post structures including more expensive materials); and the fence post assembly is easily installable and usable, e.g., using conventional methods for installing a conventional (purely wooden) fence post, and conventional methods for constructing a fence which includes a conventionally installed wooden fence post, without the need for extra parts (e.g., brackets) as are required for installation of some conventional fence post assemblies which include metal and/or plastic components.

Another aspect of the invention is a method for installing any embodiment of the inventive fence post assembly in the earth (where "earth" is used in this context in a broad sense to denote any supporting material, typically, but not necessarily, consisting essentially or primarily of dirt). For example, in a class of embodiments, the inventive method is a method for installing a fence post assembly, where the fence post assembly includes a wood post member (having a longitudinal axis, a first end surface, and a second end surface) and an elongated metal insert (having an insert longitudinal axis, a first end surface, and a second end surface), where the metal insert is positioned within the wood post member, with the first end surface of the metal insert at least substantially aligned with the first end surface of the wood post member, and the insert longitudinal axis at least substantially aligned with the longitudinal axis of the wood post member, said method including steps of:

(a) digging into earth to define a hole therein (when the fence post assembly has overall length at least substantially equal to 8 feet, step (a) is typically performed so that the hole has a depth in a range from about 1.5 ft to about 2.5 ft, or more preferably, from about 2 ft to about 2.5 ft);

(b) placing wet concrete into the hole; and (c) inserting a lowermost segment of a fence post assembly, including the first end surface of the metal insert, into the wet concrete.

Typically, step (c) includes a step of, after inserting the lowermost segment of the fence post assembly into the wet concrete, allowing the concrete to dry, or to dry and cure.

Typically the method also includes steps of:

(d) after step (c), attaching (e.g., nailing, or otherwise conventionally attaching) railing to an exposed wood portion of the fence post assembly above the earth; and (e) after step (d), cutting off (trimming) an uppermost segment of the fence post assembly above the railing.

In some such embodiments, the overall length of the fence post assembly is at least substantially equal to 8 feet, step (c) encases the lowermost segment (preferably having length in a range from about 2 feet to about 2.5 feet) of the fence post assembly in concrete, step (d) is performed to attach the fence railing to a middle segment of the fence extending from about 5 feet to about 6 feet above the concrete, and step (e) is performed to cut off a top segment of the fence post assembly having length less than or equal to about 12 inches. Preferably, the metal insert of the fence post assembly extends within most of the length of the post assembly but does not extend as far as the top segment, so that the top segment (which is cut off in step (e)) consists of wood, and the metal insert does not interfere with the trimming of the top segment.

Figure 5:
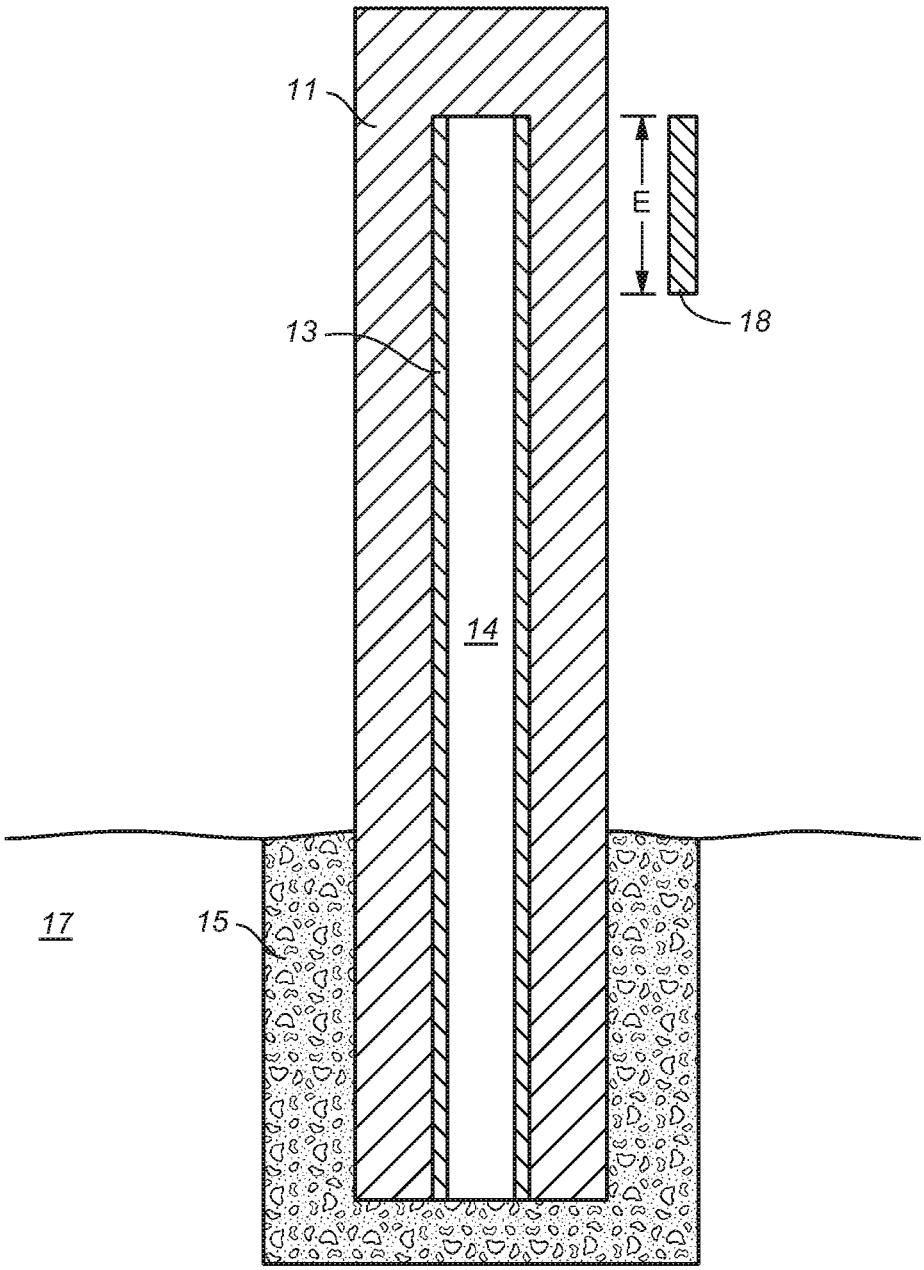
FIG. 5 is a side cross-sectional view of the FIG. 3 embodiment of the inventive fence post assembly, installed in a concrete anchor in the earth.

A typical embodiment of the noted installation method can be performed to produce the installed fence post structure shown in FIG. 5. In FIG. 5, the fence post assembly including wood fence post member 11 and metal insert 13 positioned within member 11, is shown installed in concrete anchor 15 in earth 17. To install this fence post assembly, a hole is dug into the earth 17, and wet concrete is placed into the hole. Then, the lowermost segment of the fence post assembly is inserted into the wet concrete. The wet concrete is then allowed to dry and cure, forming concrete anchor 15 which anchors the fence post assembly (including a lowermost segment of metal insert 13) in the earth 17. After the fence post assembly is anchored into the earth 17, fence railing 18 can be attached (e.g., by nailing it) to exposed wood portion E of the fence post assembly above the earth 17. Then, the uppermost segment of the fence post assembly (above portion E, and thus above the attached railing 18) can be trimmed off. Fence railing (e.g., railing 18) can be attached in a conventional manner (e.g., by nailing) to typical embodiments of the inventive fence post assembly, even in a segment of the assembly which includes the metal insert, since there is typically sufficient wood around the metal insert to allow such attachment of the railing. Alternatively, fence railing may be attached in a conventional manner (e.g., by nailing) to some typical embodiments of the inventive fence post assembly, in an upper segment of the assembly (e.g., the segment, of the FIG. 5 fence post assembly, above portion E) which does not include the metal insert (in this case too, an uppermost segment of the fence post assembly, above the attached railing, can be trimmed off).

When the inventive fence post assembly has been installed, the wood of the assembly above the concrete is the portion of the assembly likely to have the highest rate of deterioration (due to interaction with soil, water, and environmental factors). The metal portion of the post assembly is provided to maintain the post assembly's strength despite wood deterioration.

Typical types of wood for the wood portion of the inventive fence post assembly include (but are not limited to): Douglas fir, redwood, or cedar. Typically, the wood of the inventive fence post assembly is pressure-treated before installation of the assembly (e.g., before manufacture or installation of the assembly) by injecting into it creosote or another substance (e.g., in any conventional manner), to reduce its likely rate of deterioration.

Typical types of metal for the metal insert of inventive post assembly include (but are not limited to): steel (this is expected to be the best material for many applications, due to its low cost and adequate durability), galvanized steel, or other galvanized metal, aluminum, stainless steel.

The foregoing is merely illustrative and explanatory of preferred embodiments. Various changes in the component sizes and shapes, and other details of the embodiments described herein may be within the scope of the appended claims.

What is claimed is:

1. A fence post assembly, including:

a wood post member, having a longitudinal axis, a first end surface, and a second end surface; and an elongated metal insert, having an insert longitudinal axis, a first end surface, and a second end surface, wherein the metal insert is positioned within a cavity in the wood post member, with the first end surface of the metal insert at least substantially aligned with the first end surface of the wood post member, and the insert longitudinal axis at least substantially aligned with the longitudinal axis of the wood post member;

wherein the metal insert is held within the cavity by friction; and wherein the wood post member has a length L, along the longitudinal axis, and the elongated metal insert has a length P, along the insert longitudinal axis, and wherein L is greater than, or at least substantially equal to, 5 feet, and P is in the range $(0.60)\ L<P<(0.99)\ L$.

2. The assembly of claim 1, wherein the metal insert is a metal pipe having an annular cross-section, in planes perpendicular to the insert longitudinal axis.

3. The assembly of claim 1, wherein the metal insert does not extend into an end portion of the fence post assembly, said end portion of the fence post assembly including the second end surface of the wood post member.

4. The assembly of claim 1, wherein L is at least substantially equal to 8 feet, and $(0.60)\ L<P<(0.75)\ L$.

5. A method for manufacturing a fence post assembly, including steps of:

(a) removing wood from a first end of a solid wood piece having a longitudinal axis, a first end surface, and a second end surface, thereby producing a wood post member having a cavity defined therein, said wood post member having the longitudinal axis, a cored first end surface, and the second end surface; and (b) ramming an elongated metal insert, having an insert longitudinal axis, a first end surface, and a second end surface, into the cavity defined in the wood post member, such that the insert is held by friction within the wood post member with the first end surface of the metal insert at least substantially aligned with the cored first end surface of the wood post member, and the insert longitudinal axis at least substantially aligned with the longitudinal axis of the wood post member;

wherein the wood post member has a length L, along the longitudinal axis, and the elongated metal insert has a length P, along the insert longitudinal axis, and wherein L is greater than, or at least substantially equal to, 5 feet, and P is in the range (0.60) L<P<(0.99) L.

6. The method of claim 5, wherein said method includes no step, other than step (a), of removing wood from the solid wood piece or the wood post member, so that said method includes no step of forming an additional cavity in said solid wood piece or said wood post member.

7. The method of claim 5, wherein step (b) is performed such that the metal insert does not extend into an end portion of the fence post assembly, said end portion of the fence post assembly including the second end surface of the wood post member.

8. The method of claim 6, wherein L is at least substantially equal to 8 feet, and (0.60) L<P<(0.75) L.

9. The method of claim 5, wherein the elongated metal insert is a metal pipe having an annular cross-section.

10. The method of claim 5, wherein the cavity is at least substantially cylindrical, and step (a) includes longitudinally drilling out an at least substantially cylindrical inner portion of the wood piece, thereby defining said cavity in the wood piece.

11. A method for manufacturing a fence post assembly, including steps of:

(a) providing an elongated metal insert and a wood post, where the metal insert has an annular cross-section, an insert longitudinal axis, a first end surface, a second end surface, and a length P, along the insert longitudinal axis;

(b) removing an at least substantially cylindrical inner portion of the wood post, thereby defining a cavity in the wood post and producing a cored wood post member having the cavity, where the cored wood post member has a longitudinal axis, a length L, along the longitudinal axis, a first end surface, and a second end surface, and said cavity is of size and shape to receive at least a major portion of the metal insert; and (c) inserting the metal insert into the cavity of the cored wood post member, such that the metal insert is positioned relative to the cored wood post member with at least a major portion of the metal insert within the cored wood post member, and with the first end surface of the metal insert at least substantially aligned with the first end surface of the cored wood post member, and the insert longitudinal axis at least substantially aligned with the longitudinal axis of the cored wood post member, thereby producing the fence post assembly;

wherein the metal insert is held within the cavity by friction; and wherein the wood post member has a length L, along the longitudinal axis, and the elongated metal insert has a length P, along the insert longitudinal axis, and wherein L is greater than, or at least substantially equal to, 5 feet, and P is in the range (0.60) L<P<(0.99) L.

12. The method of claim 11, wherein step (b) is performed at a first station, step (c) is performed at a second station, and said method includes a step of:

after step (b) and before step (c), conveying the cored wood post member to the second station.

13. The method of claim 11, wherein step (c) is an automated ramming step.

14. The method of claim 11, wherein step (c) is performed such that the metal insert does not extend into an end portion of the fence post assembly, said end portion of the fence post assembly including the second end surface of the cored wood post member.

15. The method of claim 13, wherein L is at least substantially equal to 8 feet, and (0.60) L<P<(0.75) L.

16. A method for installing a fence post assembly, where the fence post assembly includes a wood post member and an elongated metal insert positioned within a cavity in the wood post member, the wood post member has a longitudinal axis, a first end surface, and a second end surface, and the metal insert has an insert longitudinal axis, a first end surface, and a second end surface, wherein the metal insert is held within the cavity by friction; and wherein the wood post member has a length L, along the longitudinal axis, and the elongated metal insert has a length P, along the insert longitudinal axis, and wherein L is greater than, or at least substantially equal to, 5 feet, and P is in the range (0.60) L<P<(0.99) L;

and where the first end surface of the metal insert is at least substantially aligned with the first end surface of the wood post member, and the insert longitudinal axis at least substantially aligned with the longitudinal axis of the wood post member, said method including steps of:

(a) digging into earth to define a hole therein;

(b) placing wet concrete into the hole; and (c) inserting a lowermost segment of a fence post assembly, including the first end surface of the metal insert, into the wet concrete.

17. The method of claim 16, also including steps of:

(d) after step (c), attaching railing to an exposed wood portion of the fence post assembly above the earth; and (e) after step (d), cutting off an uppermost segment of the fence post assembly above the railing.

* * * * *